US011988432B2

(12) United States Patent
Junge et al.

(10) Patent No.: US 11,988,432 B2
(45) Date of Patent: May 21, 2024

(54) REFRIGERATOR APPLIANCE HAVING AN AIR-COOLED CLEAR ICE MAKING ASSEMBLY

(71) Applicant: Haier US Appliance Solutions, Inc., Wilmington, DE (US)

(72) Inventors: Brent Alden Junge, Louisville, KY (US); Jason Andrew May, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/725,847

(22) Filed: Apr. 21, 2022

(65) Prior Publication Data

US 2023/0341163 A1 Oct. 26, 2023

(51) Int. Cl.

| | |
|---|---|
| ***F25C 1/18*** | (2006.01) |
| ***F25C 1/24*** | (2018.01) |
| ***F25C 1/25*** | (2018.01) |

(52) U.S. Cl.

CPC ..... *F25C 1/18* (2013.01); *F25C 1/24* (2013.01); *F25C 1/25* (2018.01); *F25C 2400/10* (2013.01); *F25C 2400/14* (2013.01)

(58) Field of Classification Search

CPC ..... F25C 1/18; F25C 1/24; F25C 1/25

See application file for complete search history.

(56) References Cited

U.S. PATENT DOCUMENTS

| | | | | |
|---|---|---|---|---|
| 8,567,210 | B2 | 10/2013 | Park et al. | |
| 2010/0251744 | A1* | 10/2010 | Yun | F25D 23/04 62/340 |
| 2011/0185760 | A1 | 8/2011 | Suh et al. | |
| 2012/0023997 | A1* | 2/2012 | Jung | F25D 17/065 62/340 |
| 2013/0145777 | A1 | 6/2013 | Nelson | |
| 2018/0216862 | A1 | 8/2018 | Junge et al. | |
| 2018/0238600 | A1* | 8/2018 | Lee | F25D 17/065 |
| 2021/0080159 | A1* | 3/2021 | Briggs | F25C 1/045 |

FOREIGN PATENT DOCUMENTS

| | | | | |
|---|---|---|---|---|
| KR | 1648669 B1 * | 8/2016 | | F25B 21/02 |
| WO | WO-2019007366 A1 * | 1/2019 | | F25D 11/00 |

OTHER PUBLICATIONS

Translated_Tack (Year: 2016).*
Translated_Zhang (Year: 2019).*

* cited by examiner

*Primary Examiner* — Elizabeth J Martin
*Assistant Examiner* — Samba N Gaye
(74) *Attorney, Agent, or Firm* — Dority & Manning, P.A.

(57) ABSTRACT

A refrigerator appliance may include a cabinet, a liner, a thermodynamic assembly, an air conduit, a heat pipe, a conductive ice mold, and a water dispenser. The liner may define an icebox (IB) compartment. air conduit may be disposed within the IB compartment. The air conduit may define a conduit path between a conduit inlet and a conduit outlet downstream from the conduit inlet. The heat pipe may be mounted to the air conduit and extend therefrom outside of the conduit path. The conductive ice mold may be mounted to the heat pipe within the IB compartment. The conductive ice mold may define a mold cavity outside of the air conduit. The water dispenser may be positioned below the conductive ice mold to direct an ice-building spray of water to the mold cavity.

20 Claims, 7 Drawing Sheets

REFRIGERATOR APPLIANCE HAVING AN AIR-COOLED CLEAR ICE MAKING ASSEMBLY

FIELD OF THE INVENTION

The present subject matter relates generally to refrigerator appliances, and more particularly to refrigerator appliances having a clear ice making assembly.

BACKGROUND OF THE INVENTION

In domestic and commercial applications, ice is often formed as solid cubes, such as crescent cubes or generally rectangular blocks. The shape of such cubes is often dictated by the container holding water during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water that stays static within the cavities and can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, they have certain drawbacks. For instance, such typical cubes or blocks are fairly cloudy due to impurities found within the freezing mold or water. As a result, certain consumers find clear ice preferable to cloudy ice. In clear ice formation processes, dissolved solids typically found within water (e.g., tap water) are separated out and essentially pure water freezes to form the clear ice. Since the water in clear ice is purer than that found in typical cloudy ice, clear ice is less likely to affect drink flavors.

Additionally or alternatively, typical cubes or blocks may have a size or shape that is undesirable in certain conditions. There are certain conditions in which distinct or unique ice shapes may be desirable. Specifically, relatively large or rounded ice billets or gems (e.g., around two inches in diameter) will melt slower than typical ice sizes/shapes. Slow melting of ice may be especially desirable in certain liquors or cocktails. Moreover, such billets or gems may provide a unique or upscale impression for the user.

In recent years, ice making appliances have been developed for forming relatively large ice billets in a manner that avoids trapping impurities and gases within the billet. These appliances also use precise temperature control to avoid a dull or cloudy finish that may form on the exterior surfaces of an ice billet (e.g., during rapid freezing of the ice cube). Nonetheless, such systems have generally been very bulky and unfeasible for incorporation into a commercial refrigerator appliance. In particular, the inefficiency and large mass of these dedicated appliances have made them unsuitable for use within an appliance that also stores food items (e.g., within a fresh food chamber or freezer chamber). Moreover, mounting an icemaker within the same chamber as one or more food items risks imparting undesirable flavors or require subjecting ice to temperatures better suited for storing food items.

Accordingly, further improvements in the field of ice making and refrigerator appliances would be desirable. In particular, it may be desirable to provide a refrigerator appliance capable of reliably and efficiently producing substantially clear ice billets (e.g., outside of a chamber for storing food).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a liner, a thermodynamic assembly, an air conduit, a heat pipe, a conductive ice mold, and a water dispenser. The liner may be attached to the cabinet. The liner may define an icebox (IB) compartment. The thermodynamic assembly may be mounted within the cabinet outside of the IB compartment. The thermodynamic assembly may include a chilled air supply duct and a chilled air return duct. The air conduit may be disposed within the IB compartment. The air conduit may define a conduit path between a conduit inlet and a conduit outlet downstream from the conduit inlet. The chilled air supply duct and the chilled air return duct may be in fluid communication with the air conduit to circulate air along the conduit path. The heat pipe may be mounted to the air conduit and extend therefrom outside of the conduit path to conduct heat to the conduit path. The conductive ice mold may be mounted to the heat pipe within the IB compartment to conduct heat to the heat pipe. The conductive ice mold may define a mold cavity outside of the air conduit. The water dispenser may be positioned below the conductive ice mold to direct an ice-building spray of water to the mold cavity.

In another exemplary aspect of the present disclosure, a refrigerator appliance is provided. refrigerator appliance may include a cabinet, a door, a liner, a thermodynamic assembly, an air conduit, a heat pipe, a conductive ice mold, and a water dispenser. The door may be rotatably attached to the cabinet. The liner may be mounted to the door to rotate therewith. The liner may define an icebox (IB) compartment. The thermodynamic assembly may be mounted within the cabinet outside of the IB compartment. The thermodynamic assembly may include a chilled air supply duct and a chilled air return duct. The air conduit may be disposed within the IB compartment. The air conduit may define a conduit path between a conduit inlet and a conduit outlet downstream from the conduit inlet. The chilled air supply duct and the chilled air return duct may be in fluid communication with the air conduit to circulate air along the conduit path. The heat pipe may be mounted to the air conduit and extend therefrom outside of the conduit path to conduct heat to the conduit path. The conductive ice mold may be mounted to the heat pipe within the IB compartment to conduct heat to the heat pipe. The conductive ice mold may define a mold cavity outside of the air conduit. The water dispenser may be positioned below the conductive ice mold to direct an ice-building spray of water to the mold cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
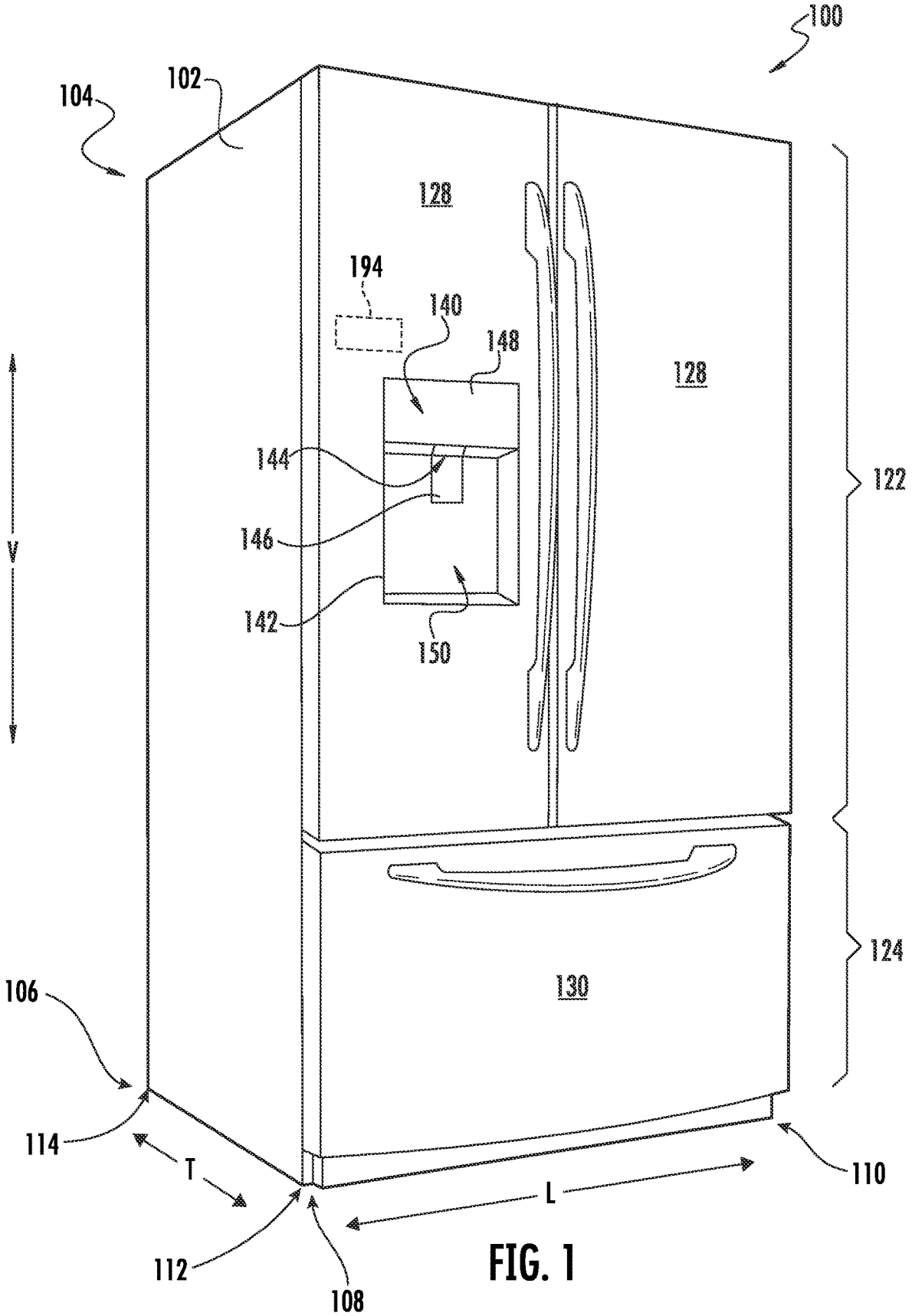
FIG. 1 provides a perspective view of a refrigerator appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In some aspects of the present disclosure, a refrigerator appliance is provided and includes a removable ice cream unit. Generally, the ice cream unit may be selectively installed or uninstalled by a user. For example, an ice dispenser unit within a door of the refrigerator may be swapped for the ice cream unit as needed. A motor that drives the ice dispenser unit may be used to drive the ice cream unit, advantageously reducing the complexity of installation and the number of different parts to be swapped.

Figure 2:
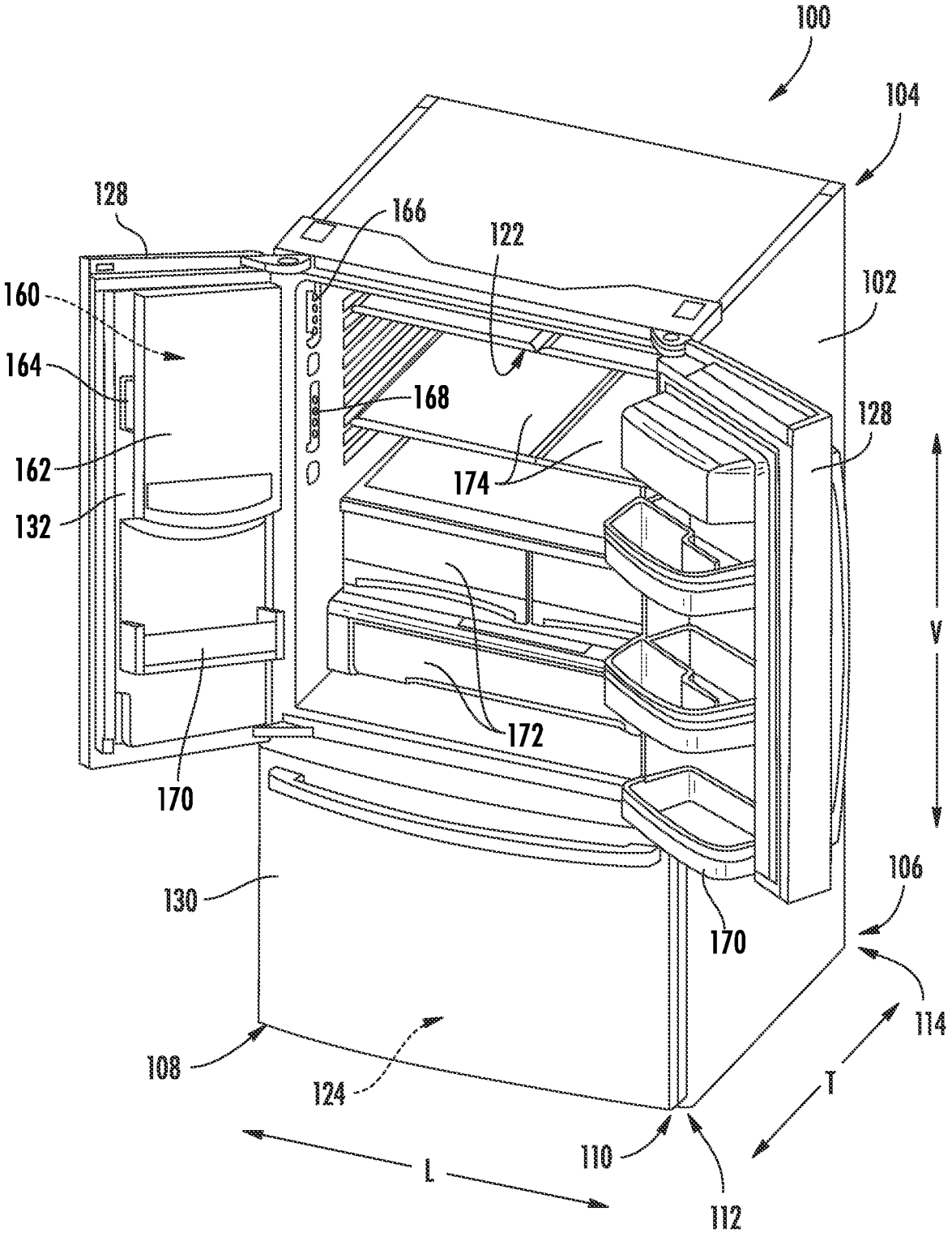
FIG. 2 provides a front view of the exemplary refrigerator appliance of FIG. 1 with the refrigerator doors shown in an open position.

Turning to the figures, FIGS. 1 and 2 illustrate a perspective view of a refrigerator 100. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages or solid food items) and may assist with organizing such food items. As an example, drawers 172 can receive fresh food items (e.g., vegetables, fruits, or cheeses) and increase the useful life of such fresh food items.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a delivery assembly 140 for delivering or dispensing liquid water or ice. Delivery assembly 140 includes a dispenser 142 positioned on or mounted to an exterior portion of refrigerator appliance 100, e.g., on one of refrigerator doors 128. Dispenser 142 includes a dispenser outlet 144 for accessing ice and liquid water. An actuating mechanism 146, shown as a paddle, is mounted below dispenser outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Dispenser outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. As described in more detail below, the dispensing assembly 140 may receive ice from an ice making assembly 300 disposed in a sub-compartment of the fresh food chamber 122.

FIG. 2 provides a perspective view of a door 128 of refrigerator appliance 100 shown with refrigerator doors 128 in the open position. As shown, a liner 132 that is attached (e.g., directly or indirectly) to cabinet 102 may define a sub-compartment, such as an icebox compartment 160 for holding an icemaker assembly. For example, at least one door 128 may include a door liner 132 defining icebox compartment 160. In such embodiments, icebox compartment 160 extends into fresh food chamber 122 when refrigerator door 128 is in the closed position. Although icebox compartment 160 is shown in door 128, additional or alterative embodiments may include an icebox compartment 160 defined within door 130. As discussed in greater detail below, an ice making assembly or ice making assembly 300 may be positioned or disposed within icebox compartment 160. In optional embodiments, an ice dispenser unit (not pictured) may also be selectively positioned within icebox compartment 160. Thus, ice may be supplied to dispenser recess 150 (see FIG. 1) from the ice making assembly 300 or ice dispenser unit 220 in icebox compartment 160 on a back side of refrigerator door 128.

An access door—e.g., icebox door 162—may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160 (e.g., by thermally isolating or insulating icebox compartment 160 from fresh food chamber 122). Generally, this thermal insulation helps maintain icebox compartment 160 at a temperature below the freezing point of water.

In addition, icebox compartment 160 may receive cooling air from a chilled air supply duct 166 and a chilled air return duct 168 disposed on a side portion of housing 102 of refrigerator appliance 100. In this manner, the supply duct 166 and return duct 168 may recirculate chilled air from a suitable thermodynamic assembly 180 (see FIG. 3) through icebox compartment 160. As will be described in greater detail below, during certain operations, chilled air (e.g., from evaporator 188 and chilled air supply duct 166) may flow to ice making assembly 300 (e.g., as motivated by an air handler or fan 192) and may assist ice formation by ice making assembly 300.

Figure 3:
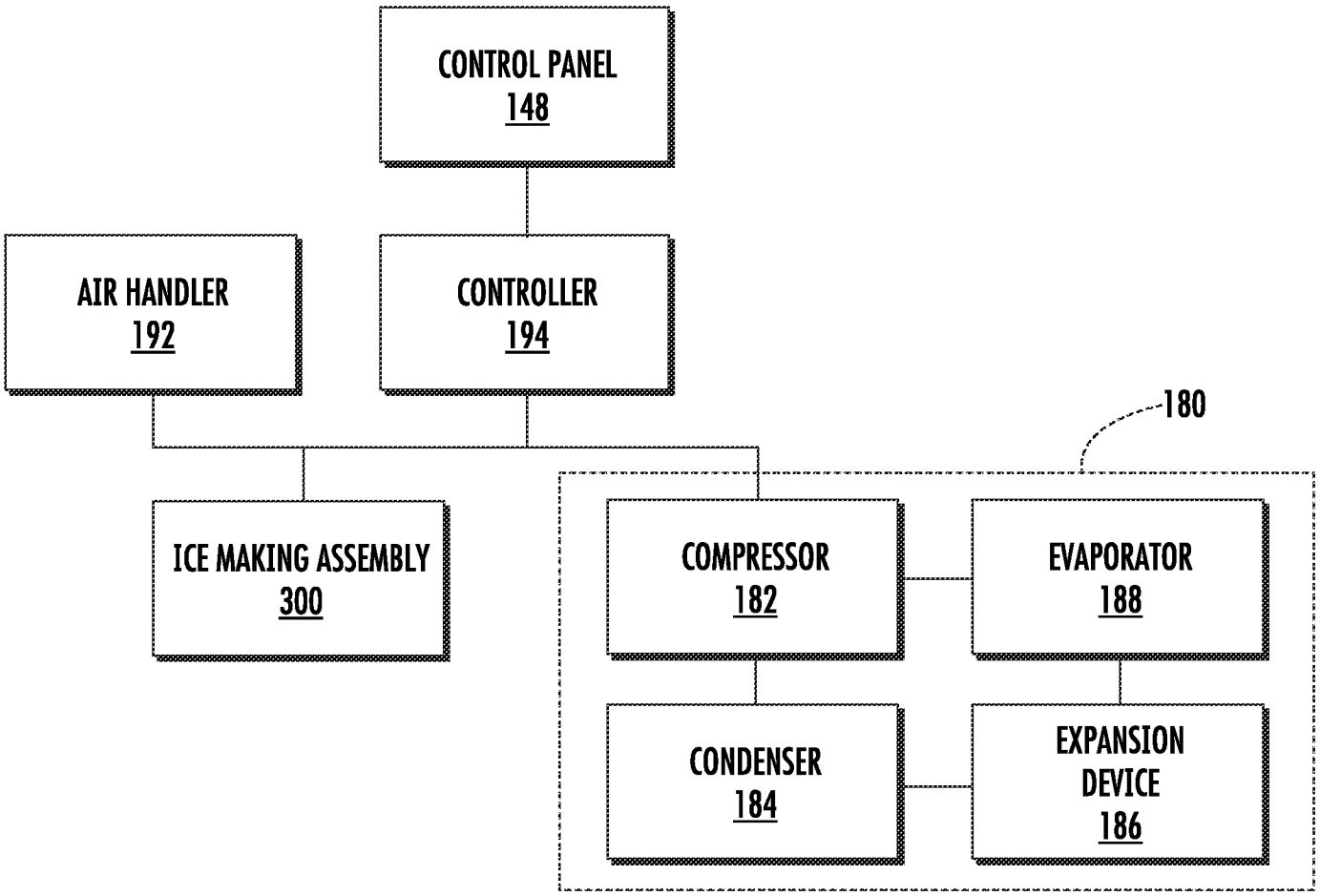
FIG. 3 provides a schematic view of various components of the exemplary refrigerator appliance shown in FIG. 1.
Figure 4:
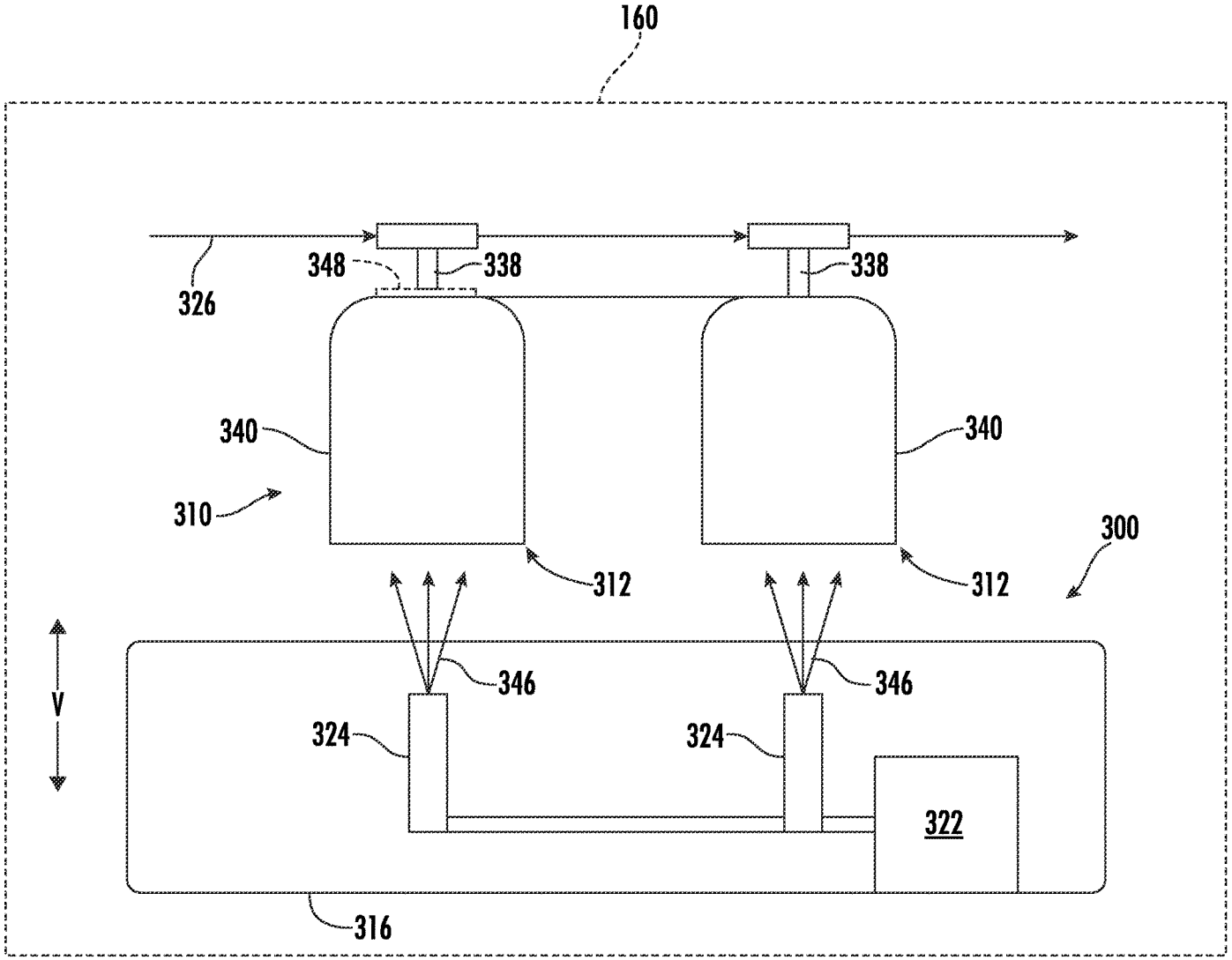
FIG. 4 provides a schematic view of an ice making assembly according to exemplary embodiments of the present disclosure.
Figure 5:
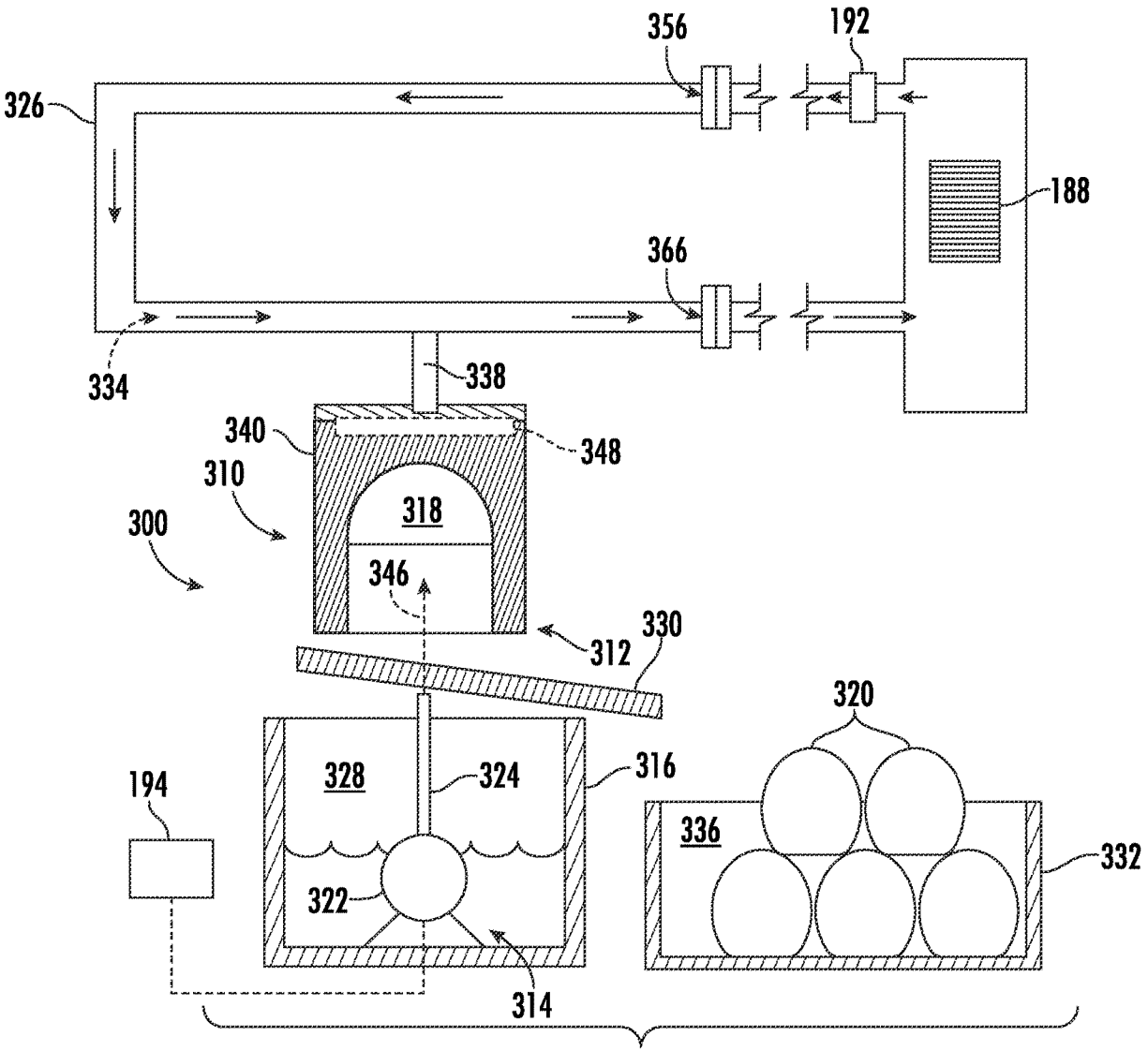
FIG. 5 provides a schematic view of an ice making assembly according to exemplary embodiments of the present disclosure.

FIG. 3 provides a schematic view of certain components of refrigerator appliance 100. As may be seen in FIG. 3, refrigerator appliance 100 includes a thermodynamic assembly 180 for cooling air within refrigerator appliance 100 (e.g., within fresh food chamber 122, freezer chamber 124, or icebox compartment 160). In some embodiments, thermodynamic assembly 180 includes a sealed cooling system for executing a vapor compression cycle. The sealed cooling system may include, for instance, a compressor 182, a condenser 184, an expansion device 186, and an evaporator 188 connected in fluid series and charged with a refrigerant. As will be understood by those skilled in the art, the sealed cooling system may include additional components (e.g., at least one additional evaporator, compressor, expansion device, or condenser). As an example, thermodynamic assembly 180 may include two evaporators.

Within the sealed cooling system, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange with ambient air takes place so as to cool the refrigerant and cause the refrigerant to condense to a liquid state.

Expansion device (e.g., a valve, capillary tube, or other restriction device) 186 receives liquid refrigerant from condenser 184. From expansion device 186, the liquid refrigerant enters evaporator 188. Upon exiting expansion device 186 and entering evaporator 188, the liquid refrigerant drops in pressure and vaporizes. Due to the pressure drop and phase change of the refrigerant, evaporator 188 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 188 is a heat exchanger which transfers heat from air passing over evaporator 188 to refrigerant flowing through evaporator 188.

It is noted that although a sealed system is described above (e.g., as a thermodynamic assembly), one of ordinary skill in the art would, in light of the present disclosure, understand that such a sealed system may be substituted for other suitable heat-exchange systems, such as a system relying on shape-memory alloys (SMA). For instance, a pair of discrete fluid circuits (e.g., a hot circuit and a cold circuit) each having a discrete volume of heat-carrying fluid (e.g., water, brine, glycol, air, etc.) may be separately connected to a compression unit housing a plurality of plate stacks each having one or more plates formed from one or more SMA material (e.g., copper-nickel-aluminum or nickel-titanium). Separate heat exchangers may generally be provided on the circuits in place of the evaporator and the condenser of a sealed system. In particular, a first heat exchanger may be provided on the cold circuit (e.g., in place of the evaporator 188) to absorb heat from the adjacent air and impart such absorbed heat to the heat-carrying fluid within the cold circuit. Thus, the first heat exchanger may also be referred to as an "evaporator" herein. Similarly, a second heat exchanger may be provided on the hot circuit (e.g., in place of the condenser 184) to release heat to the adjacent air from the heat-carrying fluid within the hot circuit. Thus, the second heat exchanger may also be referred to as a "condenser" herein.

The compression unit may facilitate or direct heat between the circuits. As an example, the compression unit may have four discrete plate stacks, each being separately compressed or released by a corresponding compressor or vice (e.g., hydraulic ram or electric actuator). During use, the plate stacks may be compressed and released (e.g., alternated between a compressed state or stroke and a released state or stroke) separately such that at any given moment one plate stack is compressed, one plate stack is released, one plate stack is mid-compression, and one plate stack is mid-release. Heat-carrying fluid in the cold circuit may flow through the first heat exchanger, before being directed (e.g., by a series of valves or pumps) into the plate stack that is currently compressed. The compressed plate stack may then be moved to the released state, in turn absorbing heat from the heat-carrying fluid before the heat-carrying fluid within the now-released plate stack is returned to the cold circuit (e.g., to repeat the cycle). In contrast to the cold circuit, heat-carrying fluid in the hot circuit may flow through the second heat exchanger and be directed (e.g., by a separate series of valves or pump) into the plate stack that is currently released. The released plate stack may then be compressed (i.e., moved to the compressed stated), in turn releasing heat from the plate stack to the heat-carrying fluid before the heat-carrying fluid within the now-compressed plate stack is returned to the hot circuit (e.g., to repeat the cycle). The use of four plate stacks may allow both circuits to run continuously.

Refrigerator appliance 100 further includes a controller 194. Operation of the refrigerator appliance 100 is regulated by controller 194 that is operatively coupled to control panel 148. In one exemplary embodiment, control panel 148 may represent a general purpose I/O ("GPIO") device or functional block. In another exemplary embodiment, control panel 148 may include input components, such as one or more of a variety of electrical, mechanical or electromechanical input devices including rotary dials, push buttons, touch pads, and touch screens. Control panel 148 may be operably connected in communication with controller 194 via one or more signal lines or shared communication busses. Control panel 148 provides selections for user manipulation of the operation of refrigerator appliance 100. In response to user manipulation of the control panel 148, controller 194 operates various components of refrigerator appliance 100. For example, controller 194 is operatively connected or in communication with compressor 182, ice making assembly 300, and air handler 192, such that controller 194 can operate such components.

Controller 194 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. For certain embodiments, the instructions include a software package configured to operate appliance 100 (e.g., according to an ice cream operation, as described below). The memory can be a separate component from the processor or can be included onboard within the processor. Alternatively, controller 194 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

Turning generally to FIGS. 4 through 9, as noted above, an ice making assembly 300 may be mounted within IB compartment 160. Generally, ice making assembly 300 includes a mold assembly 310 that defines a mold cavity 318 within which an ice billet 320 may be formed. Optionally, a plurality of mold cavities 318 may be defined by mold assembly 310 (e.g., as discrete or connected ice building units 312) and spaced apart from each other (e.g., perpendicular to the vertical direction V, such as along the lateral direction L).

As will be described in detail below, mold assembly 310 may be connected or mounted to an air conduit 326 defining a sealed or isolated conduit air path 334 within IB compartment 160 in fluid communication between the supply duct 166 and the return duct 168. In particular, the air conduit 326 provides a duct or pipe having a conduit inlet 356 and a conduit outlet 366 through which air may flow (e.g., while being isolated from or held out of mold cavity 318 or the surrounding portion of icebox compartment 160). When assembled, air conduit 326 may be in fluid communication with at least a portion of the thermodynamic assembly 180. For instance, the evaporator 188 may be in fluid communication with air conduit 326 such that chilled air flowed across the evaporator 188 (e.g., as motivated by the air handler 192) may pass to and through the air conduit 326 before being returned. Specifically, air may flow along an overall flow path from the evaporator 188, to the chilled air supply duct 166, to the air conduit 326 through the conduit inlet 356, from the air conduit 326 through the conduit outlet 366, to the chilled air return duct 168, and again to the evaporator 188. The air handler 192 itself may be mounted along the overall flow path to motivate the chilled air and include any suitable fan or blower (e.g., axial fan, tangential fan, impeller, etc.). Moreover, although a circuit or cycle for air may be provided, the conduit inlet 356 may be understood to be downstream from supply duct 166, while conduit outlet 366 is downstream from the conduit inlet 356 or upstream from the return duct 168. Stated again, the conduit inlet 356 may be downstream from the chilled air supply duct 166 to receive an airflow from the thermodynamic assembly 180 (FIG. 3), and the conduit outlet 366 may be upstream from the chilled air return duct 168 to direct the airflow to the chilled air return duct 168.

Along with or as part of air conduit 326, a heat pipe 338 may be mounted on the air conduit 326. Specifically, heat pipe 338 may extend from air conduit 326 outside of the conduit path 334 (e.g., to a corresponding unit 312 or mold 340). Each pipe 338 is generally provided as a thermally-conductive body formed from one or more suitable materials (e.g., copper or aluminum, including alloys thereof). In some embodiments, each heat pipe 338 may form one or more sealed or enclosed void 342 housing a set volume of fluid refrigerant (e.g., R134A, R600A, or isobutane) therein. In some embodiments, each heat pipe 338 is joined directly to ice mold 340 and is in conductive thermal communication with a portion of air conduit 326 within or outside of conduit path 334 (e.g., to conduct heat to air within the air conduit 326). During use, the air flowing along the conduit path 334 through the air conduit 326 adjacent to a heat pipe 338 may thus be used to selectively draw heat (e.g., via conductive or convective heat transfer) from mold cavity 318. Notably, the relatively high heat-transfer efficiency of a heat pipe 338 may facilitate or permit a relatively short or small size of air conduit 326 (e.g., than might otherwise be possible). Moreover, the described arrangement may facilitate reliable and efficient air cooling (e.g., to produce substantially clear ice billets outside of a chamber for storing food).

Optionally, mold assembly 310 may further include a thermal electric heat exchanger (TEHE) 348 mounted thereon (e.g., in conductive thermal communication with each discrete ice building unit 312 between an ice mold 340 and the corresponding heat pipe 338). In some such embodiments, the conductive ice mold 340 is spaced apart from the heat pipe 338 (e.g., by the corresponding TEHE 348). Generally, TEHE 348 may be any suitable solid state, electrically-driven heat exchanger, such as a Peltier device. TEHE 348 may include a first heat exchange end and a second heat exchange end. When activated, heat may be selectively directed between the ends. In particular, a heat flux created between the junction of the ends may draw heat from one end to the other end (e.g., as driven by an electrical current). In some embodiments, TEHE 348 is operably coupled (e.g., electrically coupled) to a controller 194, which may thus control the flow of current to TEHE 348. During use, TEHE 348 may selectively draw heat from mold cavity 318.

A water dispenser 314 positioned below mold assembly 310 may generally act to selectively direct the flow of water into mold cavity 318 (e.g., outside of air conduit 326). Generally, water dispenser 314 includes a water pump 322 and at least one nozzle 324 directed (e.g., vertically) toward mold cavity 318. In embodiments wherein multiple discrete mold cavities 318 are defined by mold assembly 310, water dispenser 314 may include a plurality of nozzles 324 or fluid pumps vertically aligned with the plurality mold cavities 318. For instance, each mold cavity 318 may be vertically aligned with a discrete nozzle 324.

In some embodiments, a water basin 316 is positioned below the ice mold 340 (e.g., directly beneath mold cavity 318 along the vertical direction V). Water basin 316 includes a solid nonpermeable body and may define a vertical opening and interior volume 328 in fluid communication with mold cavity 318. When assembled, fluids, such as excess water falling from mold cavity 318, may pass into interior volume 328 of water basin 316 through the vertical opening. Optionally, a drain conduit may be connected to water basin 316 to draw collected water from the water basin 316 and out of IB compartment.

In certain embodiments, a guide ramp 330 is positioned between mold assembly 310 and water basin 316 along the vertical direction V. For example, guide ramp 330 may include a ramp surface that extends at a negative angle (e.g., relative to a horizontal direction, such as the transverse direction T) from a location beneath mold cavity 318 to another location spaced apart from water basin 316 (e.g., horizontally). In some such embodiments, guide ramp 330 extends to or terminates above an ice bin 332 (e.g., within IB compartment 160). Optionally, guide ramp 330 may define a perforated portion that is, for example, vertically aligned between mold cavity 318 and nozzle 324 or between mold cavity 318 and interior volume 328. One or more apertures are generally defined through guide ramp 330 at perforated portion. Fluids, such as water, may thus generally pass through perforated portion of guide ramp 330 (e.g., along the vertical direction V between mold cavity 318 and interior volume 328).

In exemplary embodiments, ice bin 332 generally defines a storage volume 336 and may be positioned below mold assembly 310 and mold cavity 318. Ice billets 320 formed within mold cavity 318 may be expelled from mold assembly 310 and subsequently stored within storage volume 336 of ice bin 332 (e.g., within IB compartment 160). In some such embodiments, ice bin 332 is positioned within IB compartment 160 and horizontally spaced apart from water dispenser 314 or mold assembly 310. Guide ramp 330 may span a horizontal distance above or to ice bin 332 (e.g., from mold assembly). As ice billets 320 descend or fall from mold cavity 318, the ice billets 320 may thus be motivated (e.g., by gravity) toward ice bin 332.

As shown, controller 194 may be in communication (e.g., electrical communication) with one or more portions of ice making assembly 300. In some embodiments, controller 194 is in communication with one or more fluid pumps (e.g., water pump 322), a TEHE 348, and fan 192. Controller 194 may be configured to initiate discrete ice making operations and ice release operations. For instance, controller 194 may alternate the fluid source spray to mold cavity 318 and a release or ice harvest process, which will be described in more detail below.

During ice making operations, controller 194 may initiate or direct water dispenser 314 to motivate an ice-building spray (e.g., as indicated at arrows 346) through nozzle 324 and into mold cavity 318 (e.g., a through mold opening at the bottom end of mold cavity 318). Controller 194 may further direct fan 192 to motivate a chilled airflow (e.g., from evaporator 188 or the conduit path 334) to convectively draw heat from within mold cavity 318 during the ice building spray 346. As the water from the ice-building spray 346 strikes mold assembly 310 within mold cavity 318, a portion of the water may freeze in progressive layers from top wall 344 to a bottom end of mold cavity 318. Excess water (e.g., water within mold cavity 318 that does not freeze upon contact with mold assembly 310 or the frozen volume herein) and impurities within the ice-building spray 346 may fall from mold cavity 318 and, for example, to water basin 316. After an initial portion of ice has formed within the mold cavity 318, controller 194 may activate the TEHE 348 to further draw heat from the ice mold cavity 318, thereby accelerating freezing of ice billet 320, notably, without requiring a significant power draw.

Once an ice billet 320 is formed within mold cavity 318, an ice release or harvest process may be performed in accordance with embodiments of the present disclosure. For instance, fan 192 may be restricted or halted to slow/stop the active chilled airflow. Moreover, controller 194 may first halt or prevent the ice-building spray 346 by de-energizing water pump 322. Additionally or alternatively, an electrical current to the TEHE 348 may be reversed such that heat is delivered to mold cavity 318 from TEHE 348. Thus, controller 194 may slowly increase a temperature TEHE 348 and ice mold 340, thereby facilitating partial melting or release of ice billets 320 from mold cavities 318.

Figure 6:
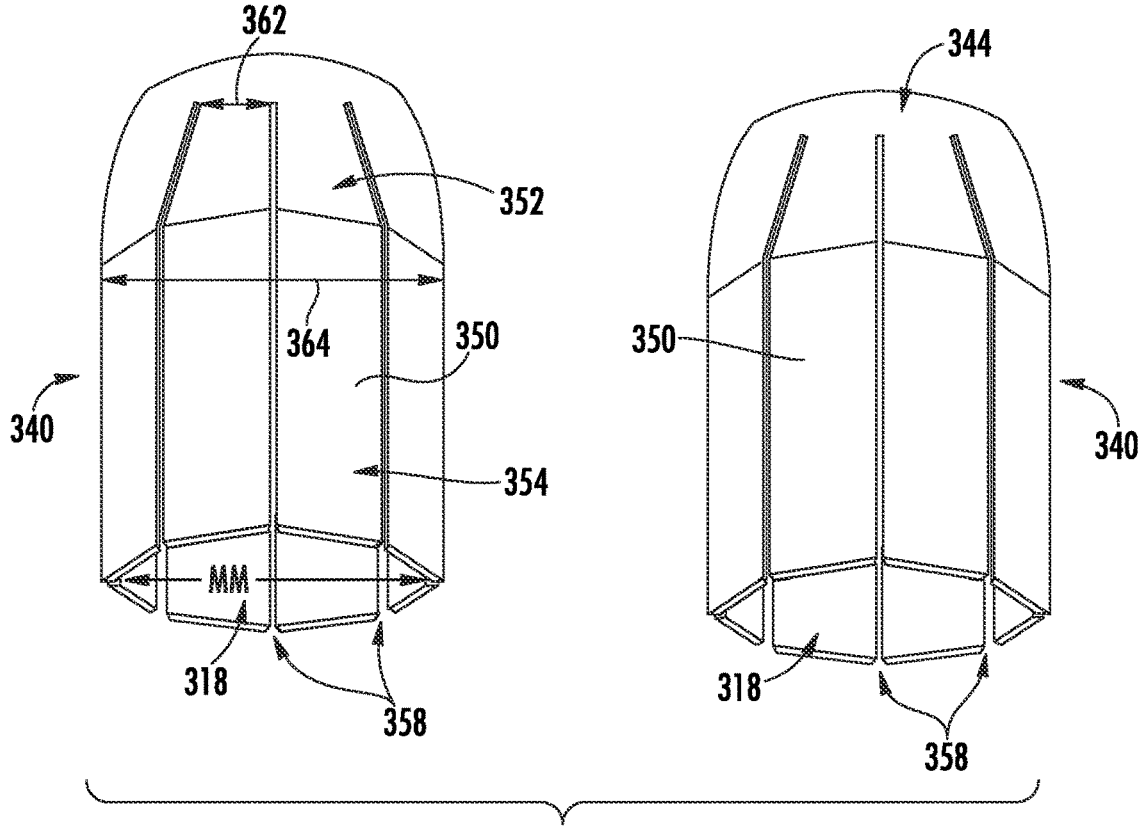
FIG. 6 provides a bottom perspective view of an ice mold according to exemplary embodiments of the present disclosure.
Figure 8:
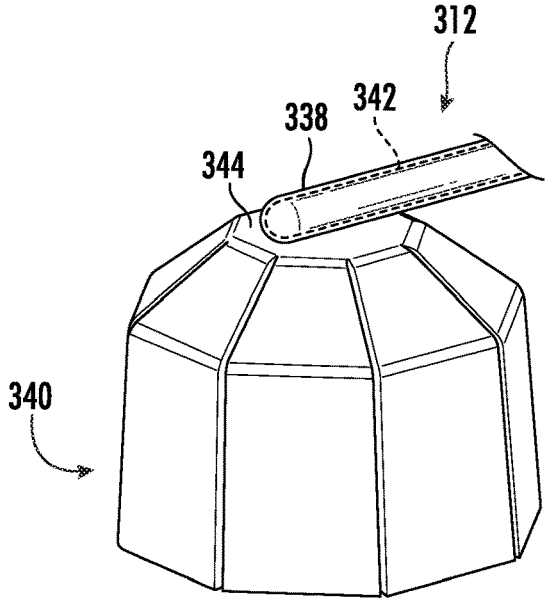
FIG. 8 provides a perspective view of an ice building unit according to exemplary embodiments of the present disclosure.

Turning now especially to FIGS. 6 and 8, ice mold 340 may include a top wall 344 and a plurality of sidewalls 350 that are cantilevered from top wall 344 and extend downward from top wall 344. More specifically, according to the illustrated embodiment, ice mold 340 includes eight sidewalls 350 that include an angled portion 352 that extends away from top wall 344 and a vertical portion 354 that extends down from angled portion 352 substantially along the vertical direction. In this manner, the top wall 344 and the plurality of sidewalls 350 form a mold cavity 318 having an octagonal cross-section when viewed in a horizontal plane. In addition, each of the plurality of sidewalls 350 may be separated by a gap 358 that extends substantially along the vertical direction V. In this manner, the plurality of sidewalls 350 may move relative to each other and act as spring fingers to permit some flexing of ice mold 340 during ice formation. Notably, this flexibility of ice mold 340 facilitates improved ice formation and reduces the likelihood of cracking.

In general, ice mold 340 may be formed from any suitable material and in any suitable manner that provides sufficient thermal conductivity to transfer heat to the surrounding environment and air conduit 326 (e.g., through a heat pipe 338) to facilitate the ice making process. According to an exemplary embodiment, ice mold 340 is formed from a single sheet of copper. In this regard, for example, a flat sheet of copper having a constant thickness may be machined to define top wall 344 and sidewalls 350. Sidewalls 350 may be subsequently bent to form the desired shape of mold cavity 318 (e.g., such as the octagonal or gem shape described above). In this manner, top wall 344 and sidewalls 350 may be formed to have an identical thickness without requiring complex and costly machining processes.

According to exemplary embodiments of the present disclosure, heat pipe 338 is mounted at or above top wall 344. When mounted, heat pipe 338 is generally in conductive thermal communication with top wall 344 (e.g., in direct mutual contact, through one or more intermediate welds or solder points, or through TEHE 348 mounted between heat pipe 338 and ice mold 340). In addition, heat pipe 338 or TEHE 348 may not be in direct contact with sidewalls 350. This may be desirable, for example, to prevent restricting the movement of sidewalls 350 (e.g., to reduce to the likelihood of ice cracking). Notably, in embodiments wherein heat pipe 338 or TEHE 348 is mounted only on top wall 344, the conductive path to each of the plurality of sidewalls 350 is through the joint or connection where sidewalls 350 meet top wall 344.

In some embodiments, such as to improve the thermal contact between heat pipe 338 and ice mold 340, it may be desirable to make top wall 344 relatively large. Therefore, according to exemplary embodiments, top wall 344 may define a top width 362 and mold cavity 318 may define a max width 364. According to exemplary embodiments, top width 362 is greater than about 50% of max width 364. According to still other embodiments, top width 362 may be greater than about 60%, greater than about 70%, greater than about 80%, or greater, of max width 364. In addition, or alternatively, top width 362 may be less than 90%, less than 70%, less than 60%, less than 50%, or less, of max width 364. It should be appreciated that other suitable sizes, geometries, and configurations of ice mold 340 are possible and within the scope of the present disclosure.

In some embodiments, a discrete heat pipe 338 may be disposed on each on each discrete ice building unit 312 above the corresponding mold cavity 318.

Figure 7:
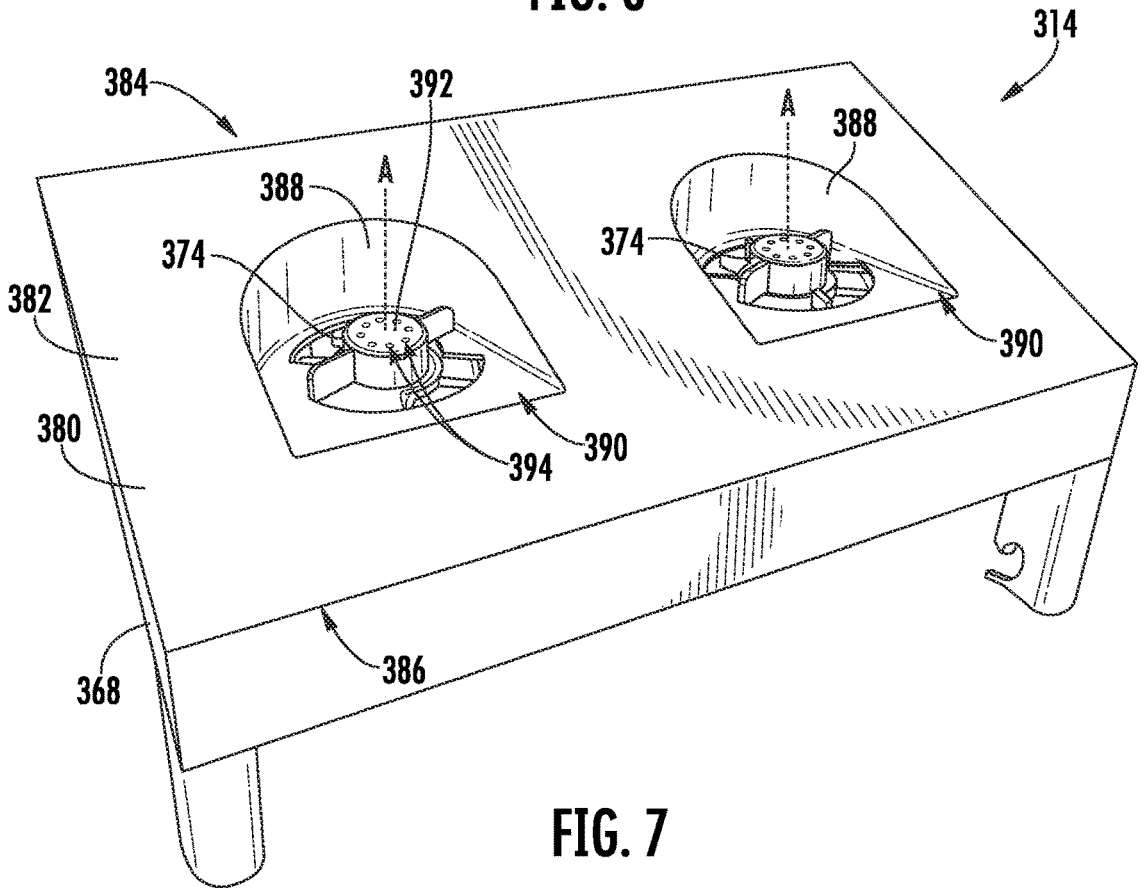
FIG. 7 provides a perspective view of a water dispensing assembly according to exemplary embodiments of the present disclosure.
Figure 9:
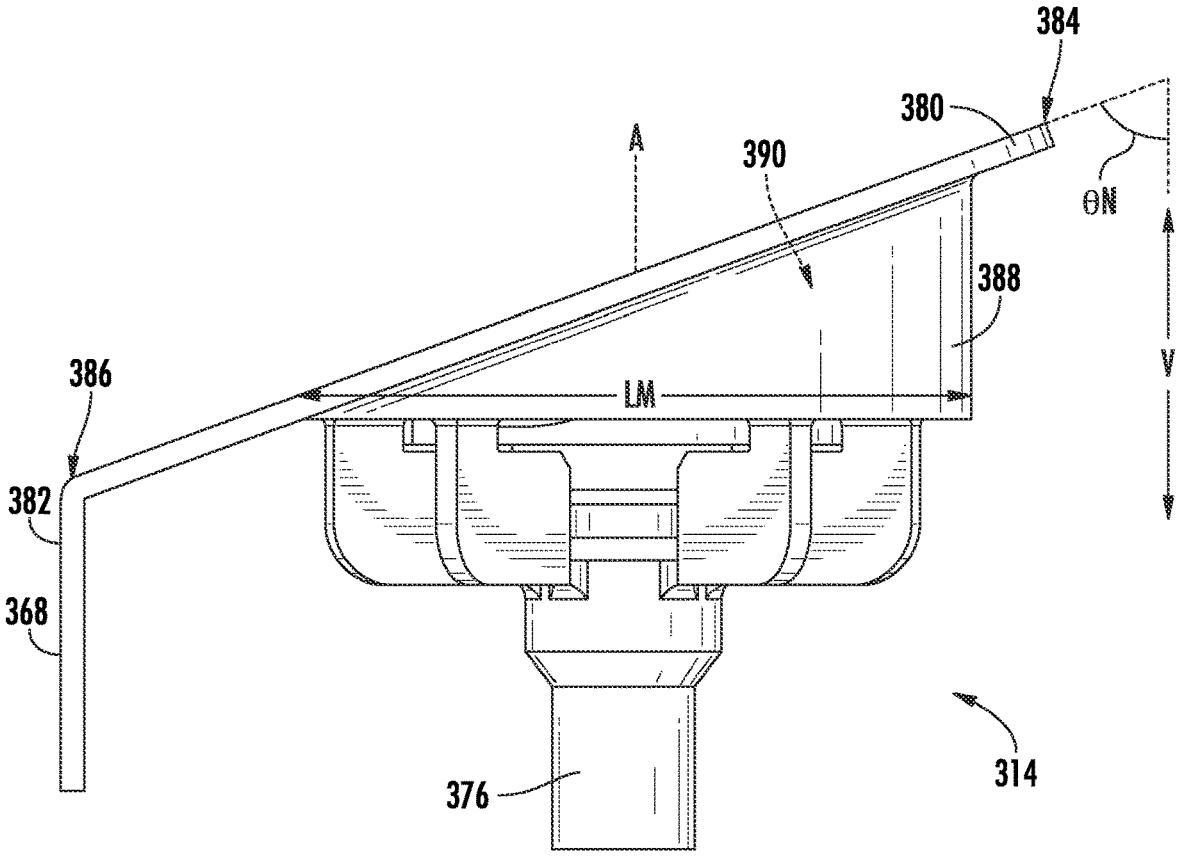
FIG. 9 provides an elevation view of the exemplary water dispensing assembly of FIG. 7.

Referring now specifically to FIGS. 7 and 9, an exemplary water dispenser assembly 314, including a dispenser base 368 and one or more nozzles (e.g., removable spray caps 374), that may be used with ice making assembly 300 will be described according to exemplary embodiments of the present disclosure. Specifically, for example, dispenser base 368 and spray cap 374 may be used as (or as part of) guide ramp 330 and nozzle 324 (e.g., FIG. 5), respectively. Thus, water dispenser 314 may be positioned below (e.g., directly below) the ice mold 340 to direct an ice-building spray of water to the mold cavity 318. Although two discrete spray caps 374 are illustrated to provide a corresponding number of ice-building sprays to ice molds thereabove, any suitable number of spray caps (and thus corresponding ice building units 312) may be provided, as would be understood in light of the present disclosure.

As shown, the dispenser base 368 generally defines one or more water paths through which water may flow to a corresponding spray cap 374. For instance, one or more conduits 376 may be provided to or beneath spray cap 374 and define the water path. Thus, water path may be upstream from the spray cap 374. Moreover, when assembled the water path may be upstream from pump 322 (FIG. 9), as would be understood in light of the present disclosure.

In some embodiments, the conduits 376 of dispenser base 368 are joined to a support deck 380 (e.g., as discrete or, alternatively, integral unitary member) on which spray cap 374 is selectively received. Support deck 380 may define a guide ramp 382 having a ramp surface that extends at a non-vertical angle θN (e.g., negative angle relative to a horizontal direction) from an upper edge 384 to a lower edge 386. When assembled the ice mold 340 (e.g., FIG. 6) may be vertically aligned below support deck 380 between the upper edge 384 and the lower edge 386 such that falling ice billets may strike guide ramp 382 and roll or slide therealong (e.g., as motivated by gravity) to the lower edge 386. From the lower edge 386, ice billets may further roll or slide into an ice bin (e.g., 332—FIG. 5), as described above. Optionally, guide ramp 382 may define a perforated portion, as further described above. Alternatively, guide ramp 382 may define a solid, non-permeable guide surface.

In certain embodiments, support deck 380 includes a cup wall 388 that defines a nozzle recess 390 within which a corresponding spray cap 374 is received. For instance, cup wall 388 may extend from or above conduit 376 such that nozzle recess 390 is defined as a vertically-open cavity through which the ice-building may flow. As shown, cup wall 388 and nozzle recess 390 may be positioned between upper edge 384 and lower edge 386. When assembled, nozzle recess 390 may thus be defined beneath or below at least a portion of guide ramp 382. For instance, a bottom surface of cup wall 388 may extend horizontally from the ramp surface of guide ramp 382 towards upper edge 384. In other words, the bottom surface of cup wall 388 may extend away from lower edge 386 and fail to cross a forward plane defined by the ramp surface along the non-vertical angle θN. The resulting nozzle recess 390 may, in turn, have a side profile that is shaped as a right triangle (e.g., enclosed within the triangular side profile of support deck 380).

Generally, nozzle recess 390 defines a horizontal profile having one or more horizontal maximums. For instance, in the illustrated embodiments, nozzle recess 390 defines a lateral maximum LM and a transverse maximum TM that is larger than the lateral maximum LM. Alternative embodiments may have a circular profile and, thus, a single horizontal maximum or diameter. In certain embodiments, the maximum horizontal recess width (i.e., largest horizontal maximum of nozzle recess 390, such as lateral maximum LM) is smaller than a maximum horizontal mold width MM (FIGS. 5 and 6) of mold cavity 318 (e.g., 364). In other words, the maximum horizontal mold width MM, which at least partially defines ice billets formed therein, is larger than the maximum horizontal recess width of nozzle recess 390. Thus, the ice billets formed in (and released from) ice mold 340 are generally larger than the opening to nozzle recess 390.

In optional embodiments, the maximum horizontal mold width MM is at least 50 percent larger than the maximum horizontal recess width (e.g., lateral maximum LM). In additional or alternative embodiments, the maximum horizontal recess width (e.g., lateral maximum LM) is less or equal to than 1.5 inches. In further additional or alternative embodiments, the maximum horizontal mold width MM is greater than or equal to 3 inches. In still further additional or alternative embodiments, the maximum horizontal mold width MM is about 1.5 inches while the maximum horizontal recess width is about 3 inches.

Advantageously, ice billets may be prevented from falling into nozzle recess 390 or otherwise blocking the ice-building spray from spray cap 374.

As shown, spray cap 374 may be positioned on at least a portion of dispenser base 368 (e.g., within nozzle recess 390). Specifically, spray cap 374 is mountable downstream from a water path to direct an ice-building spray therefrom (e.g., along a vertical spray axis A towards a corresponding mold cavity 318—FIGS. 4 and 6). Generally, spray cap 374 includes a nozzle head 392 through which one or more outlet apertures 394 are defined. In particular, spray cap 374 extends across the vertical spray axis A while the outlet apertures 394 extend upward through spray cap 374. As water flows from the conduit 376, it may thus flow through the outlet apertures 394 as the ice-building spray.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a liner attached to the cabinet, the liner defining an icebox (IB) compartment;

a heat exchanger, a chilled air supply duct, and a chilled air return duct, the heat exchanger being mounted within the cabinet outside of the IB compartment in fluid communication with the chilled air supply duct and the chilled air return duct;

an air conduit disposed within the IB compartment, the air conduit defining a conduit path between a conduit inlet and a conduit outlet downstream from the conduit inlet, the chilled air supply duct and the chilled air return duct being in fluid communication with the air conduit to circulate air along the conduit path;

a heat pipe mounted to the air conduit and extending therefrom outside of the conduit path to conduct heat to the conduit path;

a conductive ice mold mounted to the heat pipe within the IB compartment to conduct heat to the heat pipe, the conductive ice mold defining a mold cavity outside of the air conduit; and a water dispenser positioned below the conductive ice mold to direct an ice-building spray of water to the mold cavity;

wherein the air conduit is enclosed within the IB compartment above the conductive ice mold while the conduit path is fluidly isolated from a surrounding portion of the IB compartment to direct chilled air through the air conduit during the ice-building spray of water without permitting the chilled air to the surrounding portion of the IB compartment.

2. The refrigerator appliance of claim 1, wherein the heat pipe is directly joined to the conductive ice mold in conductive thermal communication therewith.

3. The refrigerator appliance of claim 1, further comprising:

a thermoelectric heat exchanger (TEHE) mounted between the heat pipe and the conductive ice mold.

4. The refrigerator appliance of claim 1, wherein the conductive ice mold is spaced apart from the heat pipe.

5. The refrigerator appliance of claim 1, wherein the heat pipe defines an enclosed void therein.

6. The refrigerator appliance of claim 1, wherein the heat pipe further comprises a refrigerant liquid held within the enclosed void.

7. The refrigerator appliance of claim 1, wherein the water dispenser is positioned directly below the conductive ice mold to direct the ice-building spray of water upward into the mold cavity.

8. The refrigerator appliance of claim 1, further comprising;

an IB fan mounted within the cabinet in fluid communication with the heat exchanger and the air conduit to motivate chilled air from the heat exchanger to the air conduit; and a controller in operable communication with the water dispenser and the IB fan the controller being configured to initiate an ice making operation comprising directing the ice-building spray of water to the mold cavity, motivating the chilled air during directing the ice-building spray of water.

9. A refrigerator appliance comprising:

a cabinet;

a door rotatably attached to the cabinet;

a liner mounted to the door to rotate therewith, the liner defining an icebox (IB) compartment;

a heat exchanger, a chilled air supply duct, and a chilled air return duct, the heat exchanger being in fluid communication with the chilled air supply duct and the chilled air return duct;

an air conduit disposed within the IB compartment, the air conduit defining a conduit path between a conduit inlet and a conduit outlet downstream from the conduit inlet, the chilled air supply duct and the chilled air return duct being in fluid communication with the air conduit to circulate air along the conduit path;

a heat pipe mounted to the air conduit and extending therefrom outside of the conduit path to conduct heat to the conduit path;

a conductive ice mold mounted to the heat pipe within the IB compartment to conduct heat to the heat pipe, the conductive ice mold defining a mold cavity outside of the air conduit; and a water dispenser positioned below the conductive ice mold to direct an ice-building spray of water to the mold cavity;

wherein the air conduit is enclosed within the IB compartment above the conductive ice mold while the conduit path is fluidly isolated from a surrounding portion of the IB compartment to direct chilled air through the air conduit during the ice-building spray of water without permitting the chilled air to the surrounding portion of the IB compartment.

10. The refrigerator appliance of claim 9, wherein the heat pipe is directly joined to the conductive ice mold in conductive thermal communication therewith.

11. The refrigerator appliance of claim 9, further comprising:

a thermoelectric heat exchanger (TEHE) mounted between the heat pipe and the conductive ice mold.

12. The refrigerator appliance of claim 9, wherein the conductive ice mold is spaced apart from the heat pipe.

13. The refrigerator appliance of claim 9, wherein the heat pipe defines an enclosed void therein.

14. The refrigerator appliance of claim 13, wherein the heat pipe further comprises a refrigerant liquid held within the enclosed void.

15. The refrigerator appliance of claim 9, wherein the water dispenser is positioned directly below the conductive ice mold to direct the ice-building spray of water upward into the mold cavity.

16. The refrigerator appliance of claim 9, further comprising;

an IB fan mounted within the cabinet in fluid communication with the heat exchanger and the air conduit to motivate chilled air from the heat exchanger to the air conduit; and a controller in operable communication with the water dispenser and the IB fan the controller being configured to initiate an ice making operation comprising directing the ice-building spray of water to the mold cavity, motivating the chilled air during directing the ice-building spray of water.

17. A refrigerator appliance comprising:

a cabinet;

a liner attached to the cabinet, the liner defining an icebox (IB) compartment;

a heat exchanger, a chilled air supply duct, and a chilled air return duct, the heat exchanger being mounted within the cabinet outside of the IB compartment in fluid communication with the chilled air supply duct and the chilled air return duct;

an air conduit disposed within the IB compartment, the air conduit defining a conduit path between a conduit inlet and a conduit outlet downstream from the conduit inlet, the chilled air supply duct and the chilled air return duct being in fluid communication with the air conduit to circulate air along the conduit path, the air conduit being enclosed within the IB compartment above a conductive ice mold while the conduit path is fluidly isolated from a surrounding portion of the IB compartment;

a heat pipe mounted to the air conduit and extending therefrom outside of the conduit path to conduct heat to the conduit path;

the conductive ice mold mounted to the heat pipe within the IB compartment to conduct heat to the heat pipe, the conductive ice mold defining a mold cavity outside of the air conduit and fluidly isolated therefrom; and a water dispenser positioned below the conductive ice mold to direct an ice-building spray of water to the mold cavity, the water dispenser being positioned directly below the conductive ice mold to direct the ice-building spray of water upward into the mold cavity;

an IB fan mounted within the cabinet in fluid communication with the heat exchanger and the air conduit to motivate chilled air from the heat exchanger to the air conduit; and a controller in operable communication with the water dispenser and the IB fan the controller being configured to initiate an ice making operation comprising directing the ice-building spray of water to the mold cavity, motivating the chilled air through the air conduit during directing the ice-building spray of water without motivating the chilled air through the surrounding portion of the IB compartment.

18. The refrigerator appliance of claim 17, further comprising:

a thermoelectric heat exchanger (TEHE) mounted between the heat pipe and the conductive ice mold.

19. The refrigerator appliance of claim 17, wherein the conductive ice mold is spaced apart from the heat pipe.

20. The refrigerator appliance of claim 17, wherein the heat pipe defines an enclosed void therein.

* * * * *